United States Patent [19]

Stewart

[11] Patent Number: 4,765,546

[45] Date of Patent: Aug. 23, 1988

[54] JAW-TYPE CRUSHING APPARATUS

[76] Inventor: Gerald W. Stewart, 299 Montgomery Street, Coquitlam British Columbia, Canada, V3K 5G1

[21] Appl. No.: 26,273

[22] Filed: Mar. 16, 1987

Related U.S. Application Data

[63] Continuation-in-part of Ser. No. 832,128, Feb. 24, 1986, abandoned.

[51] Int. Cl.[4] ..... B02C 1/06

[52] U.S. Cl. ..... 241/36; 241/37; 241/266; 241/267; 241/268

[58] Field of Search ..... 241/33, 36, 37, 266, 241/267, 268, 269

[56] References Cited

U.S. PATENT DOCUMENTS

| | | | |
|---|---|---|---|
| 2,210,790 | 8/1940 | Bernhard | 241/269 |
| 2,636,690 | 4/1953 | Roubal | 241/269 |
| 2,721,036 | 10/1955 | Uneneman et al. | 241/269 |
| 2,738,933 | 3/1956 | Dougherty | 241/264 |
| 3,326,479 | 6/1967 | Connolly et al. | 241/268 |

*Primary Examiner*—Timothy V. Eley

*Attorney, Agent, or Firm*—Fetherstonhaugh & Co.

[57] ABSTRACT

A crushing apparatus has an hydraulic cylinder for actuating a toggle mechanism connected to a moveable jaw. The apparatus may have a main frame with an opening near the top of the frame for admitting material to be crushed. There is a first jaw connected to the frame on one side of the opening by a first pivotal connection near the top of the jaw. A first toggle mechanism is operatively associated with the first jaw. There may also be a second jaw connected to the frame on a side of the opening opposite the first jaw by a second pivotal connection near the bottom of the second jaw. A second toggle mechanism is operatively associated with the bottom mounted jaw. The crushing apparatus may have a toggle mount which is movable towards or away from the associated jaw.

21 Claims, 10 Drawing Sheets

JAW-TYPE CRUSHING APPARATUS

RELATED APPLICATION

This application is a continuation-in-part of my previous U.S. Pat. application No. 06/832,128 filed Feb. 24, 1986, now abandoned.

BACKGROUND OF THE INVENTION

The invention relates to a hydraulically operated toggle-type jaw crusher typically used for fracturing rocks.

The Blake or double toggle jaw crusher is commonly used for crushing rocks or the like. It is considered very efficient because the movement of the movable jaw is relatively straight towards the stationary jaw with little relative motion along the jaw surfaces, thus reducing friction caused by grinding action. This lowers the power requirements for the crusher and the jaws have a longer life. The design of double toggle jaw crushers has changed relatively little since their introduction over a century ago, other than replacing babbit bearings with massive roller bearings to reduce friction and power requirements.

One disadvantage of the double toggle jaw crusher is the reduced distance of travel at the top of the movable jaw because the top is closer to the pivot about which the jaw rotates. This makes it difficult to crush large rocks entering the top of the jaw chamber.

Another disadvantage is illustrated by the fact that most manufacturers offer two or three models of each size of jaw crusher. The different models are required because different distances of travel between the movable jaw and the stationary jaw are required for different purposes. It is also desirable to change the angle between the toggles which governs the pressure exerted by the jaws and the speed of movement of the movable jaw. When crushing very hard material, a relatively short distance of travel and a relatively flat angle between the toggles is desirable. When the materials being crushed are softer, a greater degree of movement and a larger angle is desired. These jaw crushers are typically powered by an inertial drive including an eccentric. It is not practical to change the eccentric shaft, bearings and other parts to change the crusher from one type of material to another.

The conventional jaw crushers employing large belt driven flywheels are very hazardous. The large inertia of the flywheels means that they cannot be stopped immediately in the event of accidents. Many people have been killed or maimed by falling into jaw crushers or by being caught in the flywheel or belts.

Furthermore, the action of the flywheels, counterweights and eccentric shafts creates a violent rocking motion requiring a massive base structure sufficient to take the weight of the machine and the extreme vibration due to its action.

Hydraulically operating jaw crushers have been developed as shown for example in U.S. Pat. No. 4,406,416 to Tateishi. The jaw crusher shown in this patent has a single movable jaw operated by a hydraulic cylinder connected to a lever mechanism. The stationary jaw has an upper portion which can be fixed in an optional position by advancing or withdrawing this portion of the stationary jaw horizontally.

SUMMARY OF THE INVENTION

The invention provides a crushing apparatus having a main frame with a top. There is an opening near the top of the main frame for admitting material to be crushed. A first jaw with a top is connected to the frame on one side of the opening by a first pivotal connection near the top of the jaw. A first toggle mechanism is operatively associated with the first jaw. A second jaw with a bottom is connected to the frame on a side of the opening opposite the first jaw by a second pivotal connection near the bottom of the second jaw. There is a second toggle mechanism operatively associated with the second jaw.

Preferably, there is a first hydraulic cylinder operatively associated with the first toggle mechanism for providing movement of the first jaw about the first pivotal connection and a second hydraulic cylinder operatively associated with the second toggle mechanism for providing movement of the second jaw about the second pivotal connection.

The apparatus may have a control mechanism for controlling the first and second hydraulic cylinders through an operating cycle where the second jaw is initially held stationary in an initial position while the first jaw is moved towards the second jaw, then the first jaw is held stationary while the second jaw is moved from the initial position towards the first jaw and then both jaws are retracted to their respective initial positions.

The invention also provides a crushing apparatus with a main frame and an opening near the top of the frame for admitting material to be crushed. There is a pair of jaws mounted on the frame on opposite sides of the opening, one of the jaws being pivotally mounted on the frame. There is a toggle mechanism connected to the one jaw for moving the one jaw to crush material between the jaws. The toggle mechanism has a primary toggle with a first end pivotally mounted on the one jaw and a second end. There is a secondary toggle having a first end pivotally mounted on the second end of the primary toggle and a second end pivotally mounted on a toggle mount movably mounted on the frame. There is an hydraulic cylinder connected to the primary toggle near the second end thereof for powering the toggle mechanism.

The invention may also provide a crushing apparatus with a time delay means for adjustably delaying movement of one jaw towards the other jaw.

One advantage of the invention is that it retains the benefits of the standard double toggle jaw crusher, while eliminating disadvantages. The dangers and disadvantages associated with the inertial drive are removed by employing an hydraulic drive. Advantageously, one can build in a time delay mechanism for delaying the closing of the jaws to facilitate passage of rock through the crusher. In addition, in an overhead single toggle jaw crusher the rotary movement of the jaws from an eccentric causes wear of the wear plates of the charger. Wear resulting from this cause is eliminated by the hydraulically actuated double toggle mechanism.

The use of two movable jaws increases the crushing efficiency throughout the length of both jaws and makes it easier to crush large rocks entering the top of the jaw chamber. The disadvantage of the lessening of travel near the hinge point of a single jaw is removed. By providing an adjustable initial toggle angle position for at least one movable jaw, the same crusher can be adjusted to crush softer or harder materials. In addition, such a crushing apparatus can be instantly stopped and instantly started without removing material from the crushing chamber. Neither is possible with conventional crushers.

DESCRIPTION OF THE PREFERRED EMBODIMENTS

Figure 1:
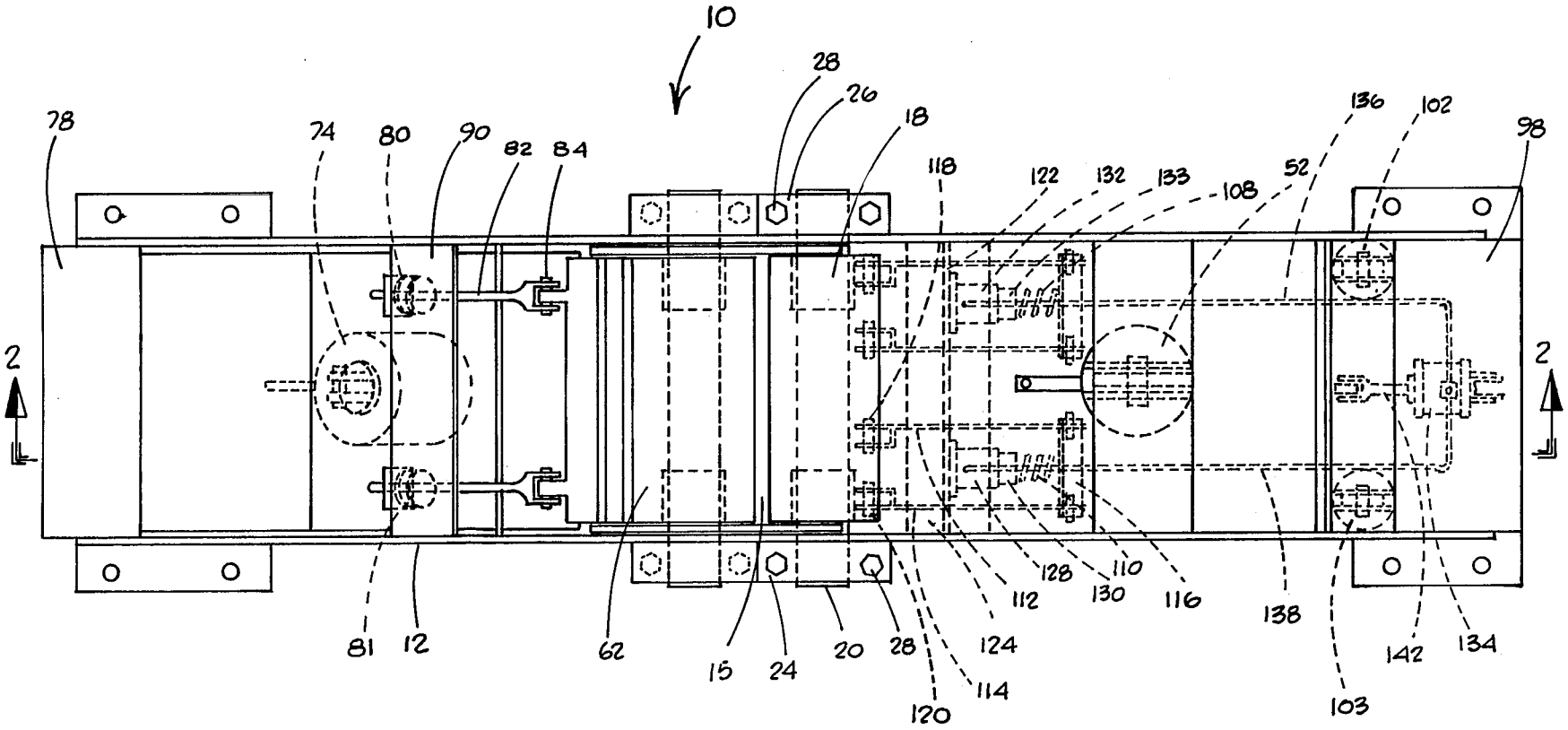
FIG. 1 is a top plan view of a crushing apparatus according to an embodiment of the invention.
Figure 2:
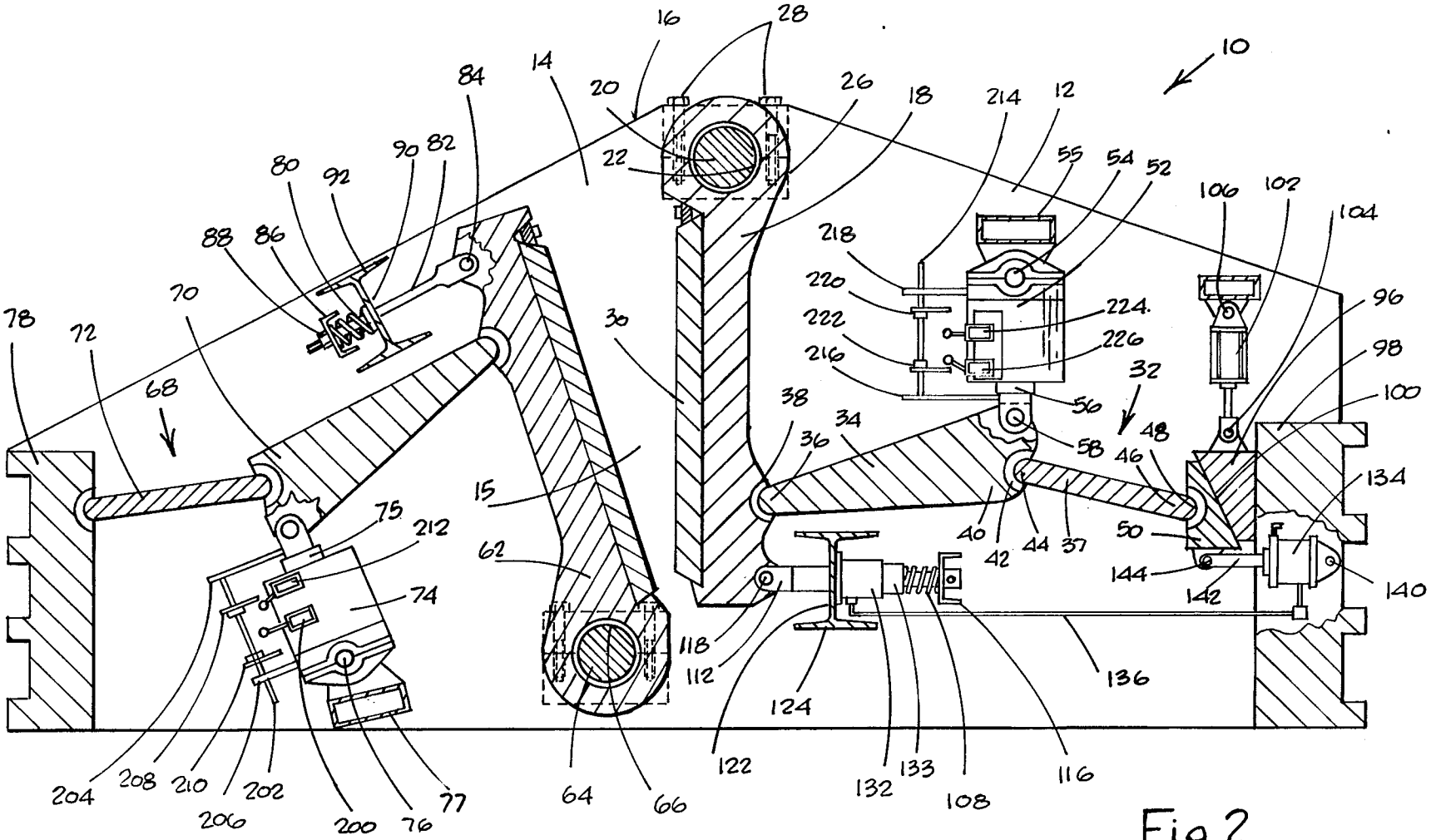
FIG. 2 is a sectional view taken along line 2—2 of FIG. 1 and showing the two jaws in their initial position.
Figure 3:
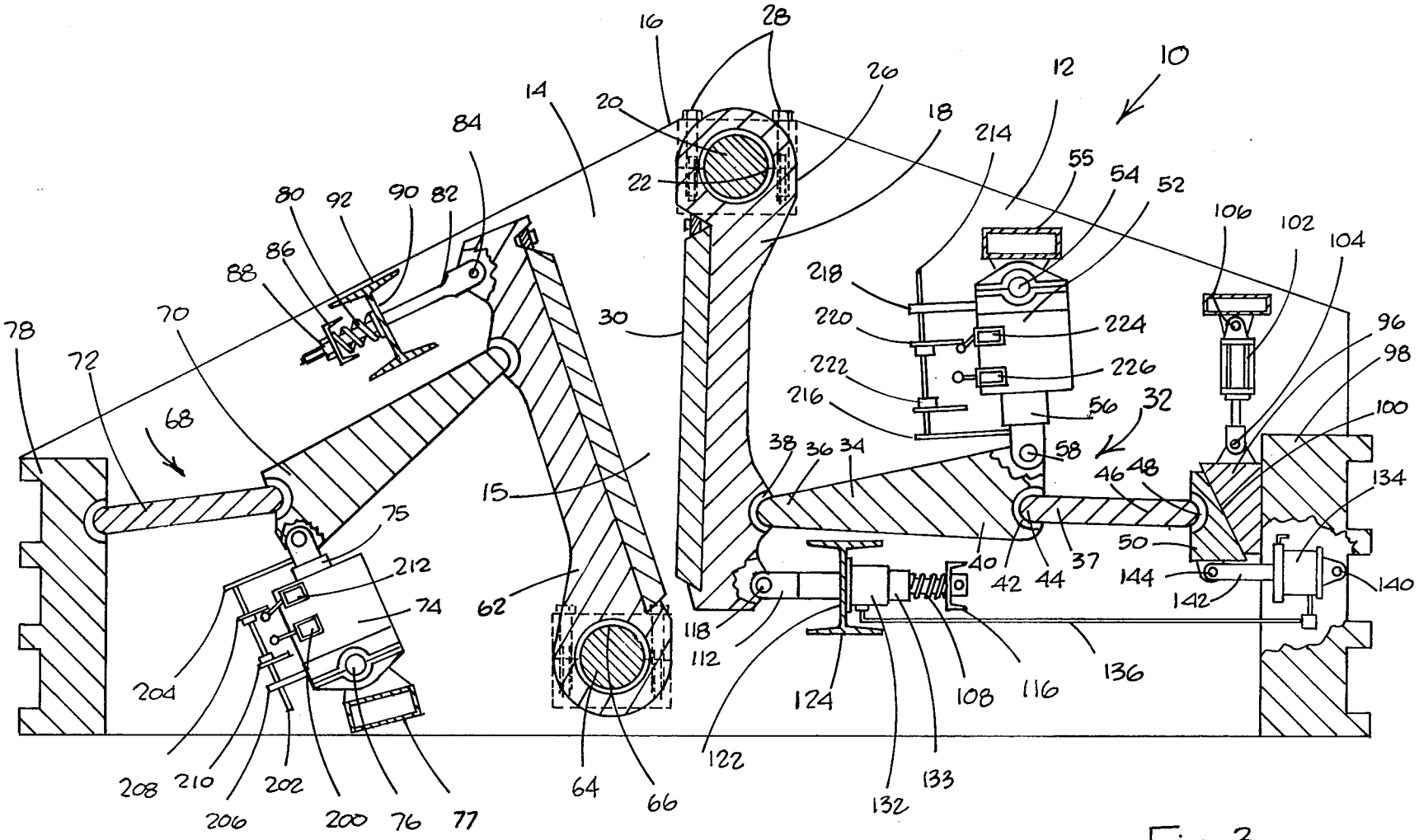
FIG. 3 is a view similar to FIG. 2, but showing the jaws after movement of the first jaw.
Figure 4:
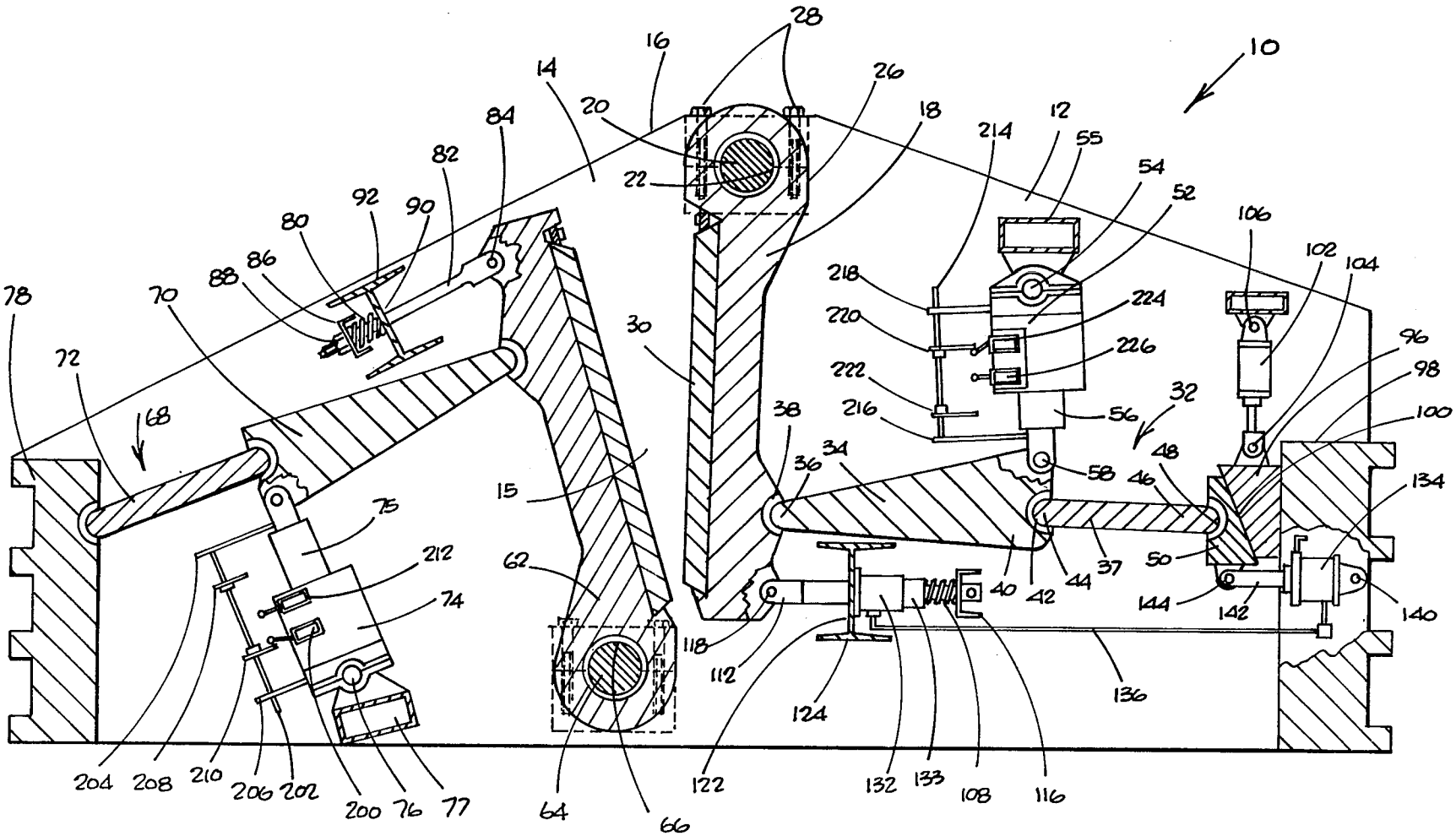
FIG. 4 is a view similar to FIGS. 2 and 3, but showing both jaws after movement.

FIGS. 1–4 show a crushing apparatus 10 according to an embodiment of the invention. The apparatus includes a main frame 12 which has an opening 14 near top 16 of the frame as seen in FIGS. 2–4. Opening 14 is at the top of a jaw chamber 15.

The apparatus also has a first jaw 18 which is pivotally connected to the frame 12 by a trunnion 20 mounted on the frame and a bore 22 in the jaw near the top thereof. The trunnion is rigidly mounted to the frame near the top of the apparatus by two members 24 and 26 each of which has a top half and a bottom half connected together by bolts 28. The jaw 18 has a wear plate 30 and is reciprocated by means of a toggle mechanism 32 shown in FIGS. 2–4. The toggle mechanism includes a primary toggle 34 and a secondary toggle 37. The primary toggle has a first end 36 which is round and mounts pivotally on a concave seat 38 of jaw 18. The primary toggle has a second end 40 provided with a concave seat 42 which pivotally receives rounded first end 44 of secondary toggle 37. The secondary toggle also has a rounded second end 46 pivotally received in a concave recess 48 of a movable toggle mount 50 which is mounted on frame 12. The jaw 18 is reciprocally rotated about trunnion 20 by means of the toggle mechanism 32. The jaw is retracted when the primary toggle and the secondary toggle are at an angled position as shown in FIG. 2 and is advanced when the toggles are more aligned as shown in FIGS. 3 and 4. As described to this point the mechanism is generally conventional, the toggle mechanism in prior art devices usually being activated by an inertial drive including a flywheel and an eccentric which acts on the second end 40 of the primary toggle 34.

Apparatus 10 differs in part from most prior art devices by employing a hydraulic cylinder 52 as actuating means for providing movement of the jaw 18 about the trunnion 20. Cylinder 52 is pivotally mounted on frame 12 by means of a trunnion 54 mounted on a crossmember 55. The cylinder has a piston 56 which is connected to second end 40 of the primary toggle 34 by means of a trunnion 58 which is rotatably received in toggle 34. Hydraulic fluid is provided to the cylinder to advance piston 56 and actuate the toggle mechanism and jaw as may be seen by comparing FIG. 2 with FIGS. 3 and 4. FIG. 2 shows the piston in its retracted position, while FIGS. 3 and 4 show it extended.

Apparatus 10 also departs from the standard jaw crusher in having a second movable jaw 62 in place of a stationary jaw. Jaw 62 is bottom mounted, having a bore 66 rotatably received on a trunnion 64 which is mounted on the frame. Jaw 62 has an associated toggle mechanism 68 including a primary toggle 70, a secondary toggle 72 and a hydraulic cylinder 74 which is pivotally mounted on the frame by means of a trunnion 76 on a crossmember 77. The jaw and the associated components just described are equivalent to jaw 18 and the associated toggle mechanism and therefore will not be described in detail. Basically the jaw 62 and the toggle mechanism 68 are inverted when compared with jaw 18 and its toggle mechanism 32. Toggle mechanism 68 is mounted on the frame by means of a stationary toggle mount 78 however, unlike the toggle mount 50 employed with toggle mechanism 32 which is movable as described below. In addition, jaw 62 has conventional coil springs 80 and 81, the latter shown only in FIG. 1, which tend to bias jaw 62 for counter-clockwise rotation from the point of view of FIGS. 2–4. These springs maintain contact between the jaw and the toggle mechanism. A rod 82 is pivotally connected to jaw 62 by means of a pin 84 as shown in FIGS. 2–4. A channel-shaped spring seat 86 is retained on the opposite end of the rod by means of a nut 88. The end of spring 80 opposite the spring seat rests against web 90 of H-beam type brace 92. Rod 82 passes slidably through an aperture in web 90. Similar parts are associated with spring 81. This arrangement is conventional for jaw crushers.

By way of comparison with jaw 62 and its toggle mechanism 68, jaw 18 and its toggle mechanism vary in that the associated toggle mount 50 is movable towards and away from the jaw. This is accomplished as shown in FIGS. 2–4 by providing a wedge 96 which is interposed between a toggle abutment 98 fixedly mounted on the frame and angled surface 100 on toggle mount 50. A hydraulic cylinder 102 is connected to wedge 96 by means of a pin 104. Another pin 106 serves to mount the cylinder 102 on the frame. A second cylinder 103 is connected to the wedge on the opposite side of the apparatus as shown in FIG. 1. It may be observed that when wedge 96 is moved downwardly, this serves to move toggle mount 50 towards the jaw 18. This adjusts the distance between the two jaws 18 and 62 when the primary and secondary toggles are at any given angle to each other to compensate for wear of the jaw liners or to suit the size of material being crushed. For example, the initial position of jaw 18 is shown in FIG. 2 when the toggles are more angled rather than straighter. If wedge 96 is moved downwardly, it moves both toggles 34 and 37 towards jaw 18, thus moving jaw 18 towards jaw 62. Rotation of cylinder 52 about trunnion 54 accommodates this movement.

Because of the variable initial positions possible for jaw 18, a conventional coil spring arrangement as used with jaw 62 cannot be used. A pair of coil springs 108 and 110, shown in FIG. 1, are used. Referring firstly to spring 110, a pair of bars 112 and 114 connect spring seat 116 to the jaw. Bar 112 is connected to the jaw in a pivotal manner by pin 118, while bar 114 is connected to the jaw in a pivotal manner by an equivalent pin 120.

The bars extend slidably through apertures in web 122 of H-beam type brace 124. A hydraulic cylinder 128 is mounted on the web 122 facing spring 110. Its piston 130 rests against spring 110 on the side opposite spring seat 116. Spring 108 is mounted in a similar manner and has an equivalent hydraulic cylinder 132 with a piston 133. Cylinders 128 and 132 are hydraulically connected to cylinder 134 in parallel by hydraulic lines 136 and 138 shown in FIG. 1. Cylinder 134 is mounted on the frame by means of a mounting pin 140 shown in FIGS. 2–4. Its piston rod 142 extends horizontally and is connected to toggle mount 50 by a pin 144. Cylinder 134 has an internal cross-sectional area and piston which have double the area of the internal cross-sectional area and piston of each of the cylinders 128 and 132. The cylinders 134, 128 and 132 are coupled together so that as toggle mount 50 moves towards jaw 18, the piston in cylinder 134 is retracted, allowing hydraulic fluid in cylinders 128 and 132 to escape to cylinder 134. Thus the original spring tension is maintained despite the movement of the toggle springs. The fluid is trapped in the rod end of cylinder 134. The piston end is vented to atmosphere. The pistons of cylinders 128 and 132 are thus retracted, effectively permitting movement of coil springs 108 and 110 towards the jaw. The degree of movement of pistons 130 and 133 is the same as the piston of cylinder 134 and toggle mount 50. Consequently, for the initial position of the jaw 18, a constant pressure is exerted by springs 108 and 110 maintaining contact between the jaw 18 and the toggle mechanism 32.

The apparatus also includes a control mechanism for controlling cylinders 52 and 74 through an operating cycle where the bottom mounted jaw 62 is initially held stationary in an initial position, as shown in FIGS. 2 and 3, while the top mounted jaw is moved towards the bottom mounted jaw as shown by comparing FIGS. 2 and 3. The top mounted jaw is then held stationary while the bottom mounted jaw is moved from its initial position shown in FIGS. 2 and 3 towards the top mounted jaw as shown in FIG. 4. Finally both jaws are retracted to their respective initial positions shown in FIG. 2. This cycle is desirable in the preferred embodiment because of the different leverages of the two jaws. Jaw 62 has appreciably greater leverage against uncrushed materials in the lower part of jaw chamber 15 where material is crushed to a smaller size because these materials occur relatively close to its pivot about trunnion 64. By comparison, these uncrushed materials are acted against by the bottom of jaw 18 which is displaced the maximum distance from its pivot 20. The unequal leverage means that there is a tendency for jaw 62 to overcome the pressure of jaw 18 and attempt to reverse it.

Figure 5:
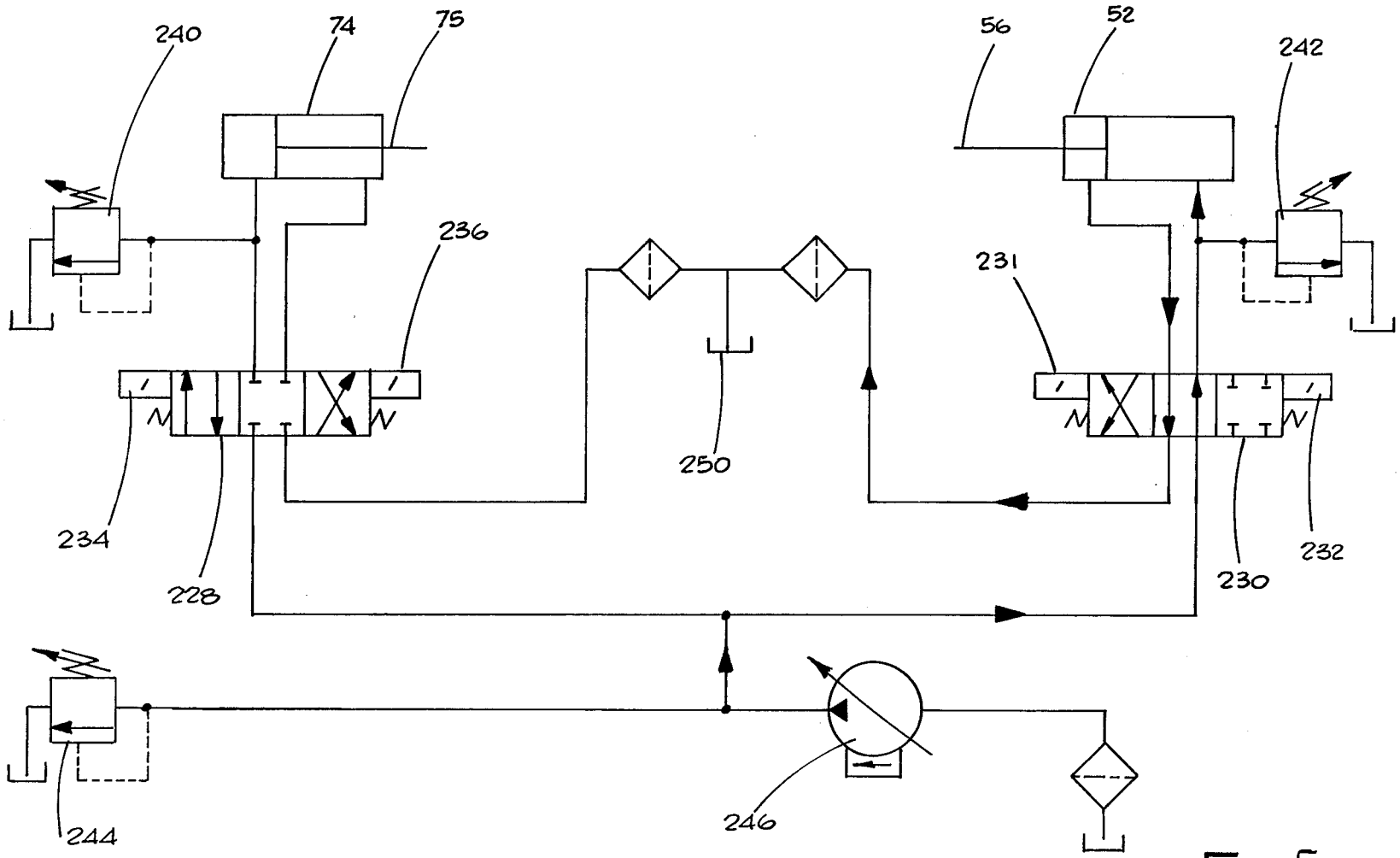
FIGS. 5–7 are schematic diagrams showing the hydraulic system for the jaw cylinders in three different phases of operation of the apparatus corresponding to FIGS. 2, 3 and 4, respectively.
Figure 6:
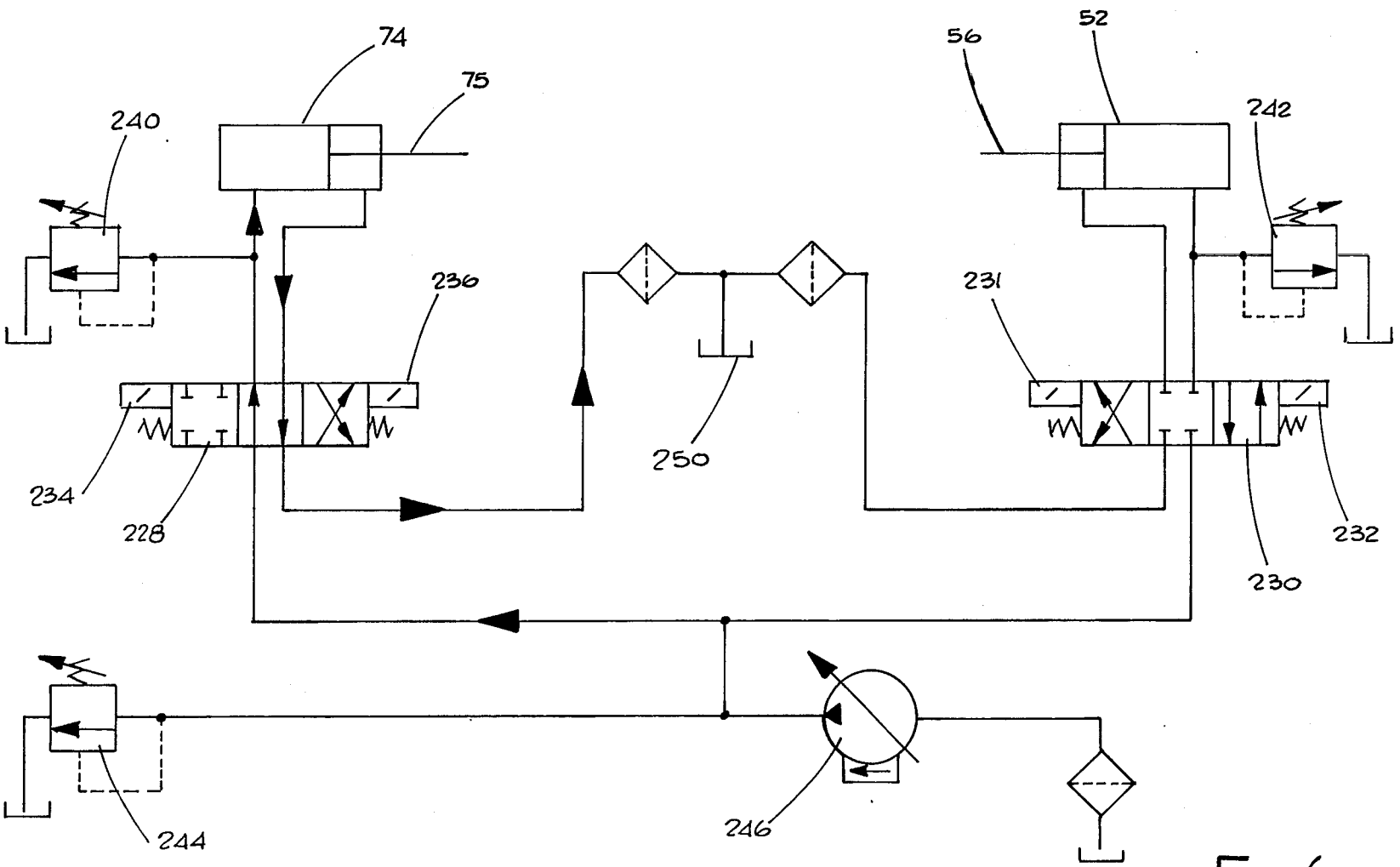
Figure 7:
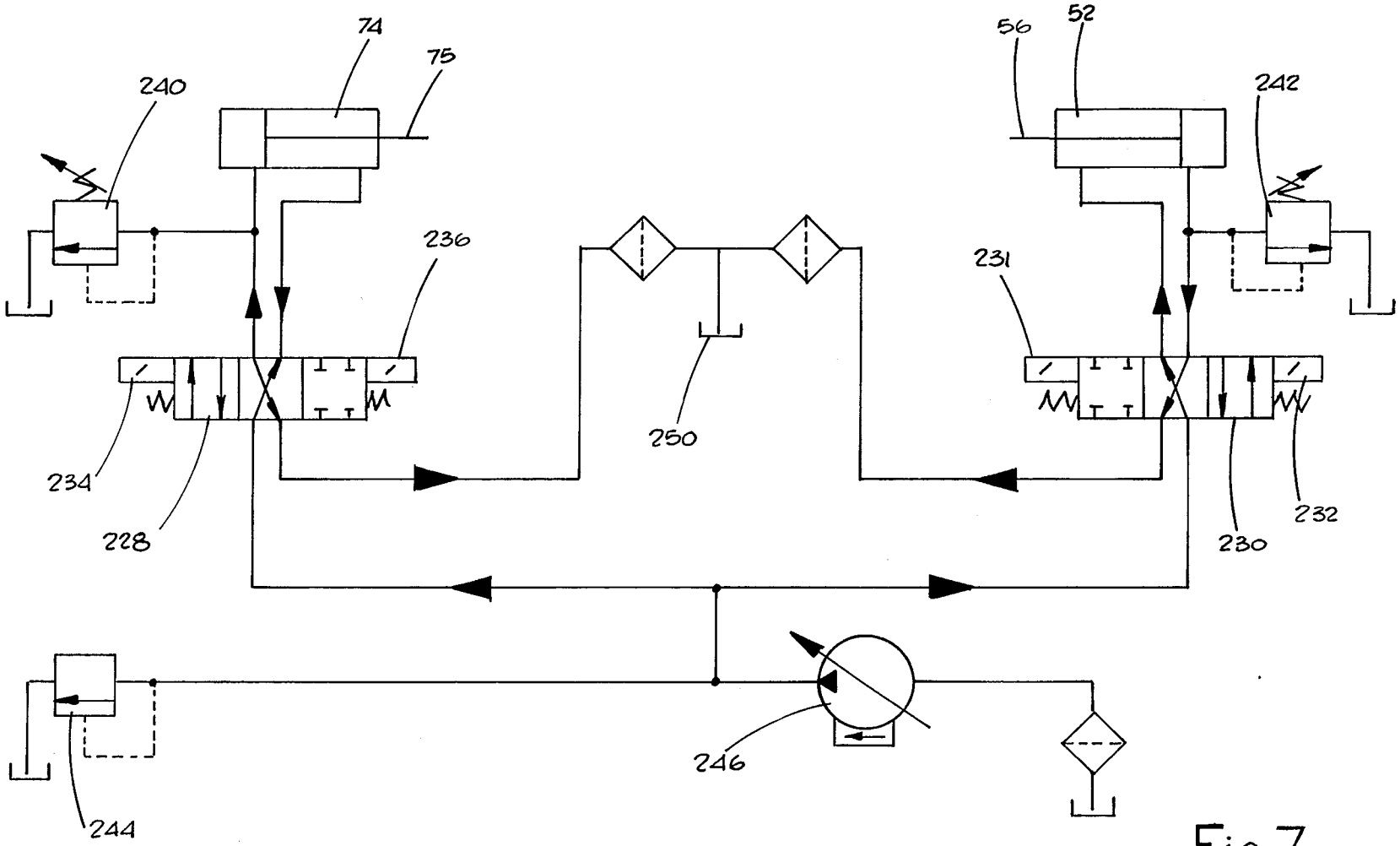

The jaws are controlled by a hydraulic control system shown in FIGS. 5–7 corresponding respectively to the positions of the jaws in FIG. 2–4 which show limit switches forming part of the control system. A vertically sliding rod 202 is pivotally connected to a bracket 204 on piston 75 of cylinder 74 and is guided for axial movement by a guide 206 on the cylinder. Two limit switch stops 208 and 210 are fixedly connected on the rod. These stops control a pair of limit switches 200 and 212. Similarly, a rod 214 is connected to bracket 216 on piston 56 of cylinder 52 and is guided for axial movement by a guide 218. Two limit switch stops 220 and 222 control two limit switches 224 and 226. The stops are moved toward or away from the limit switches to vary the initial toggle angle and the length of the stroke of the respective cylinder 52 or 74.

Referring to FIGS. 5–7, the hydraulic system together with cylinders 74 and 52 are shown schematically. Fluid movement towards and away from selected ends of cylinder 74 is controlled by a four way directional control valve 228, while fluid flow towards and away from cylinder 52 is similarly controlled by another four-way directional control valve 230. Both valves in this embodiment are spool valves. Valve 228 is actuated by solenoids 234 and 236, while valve 230 is actuated by similar solenoids 231 and 232. The solenoids are controlled by the limit switches described above which are connected to the solenoids by means of conventional relays. The cylinders are provided with tramp iron relief valves 240 and 242 which relieve pressure in the cylinders if tramp iron is encountered between the jaws. The hydraulic system also includes a main pressure relief valve 244, a variable displacement pressure compensated pump 246. This system has a hydraulic fluid reservoir 250.

Figure 8:
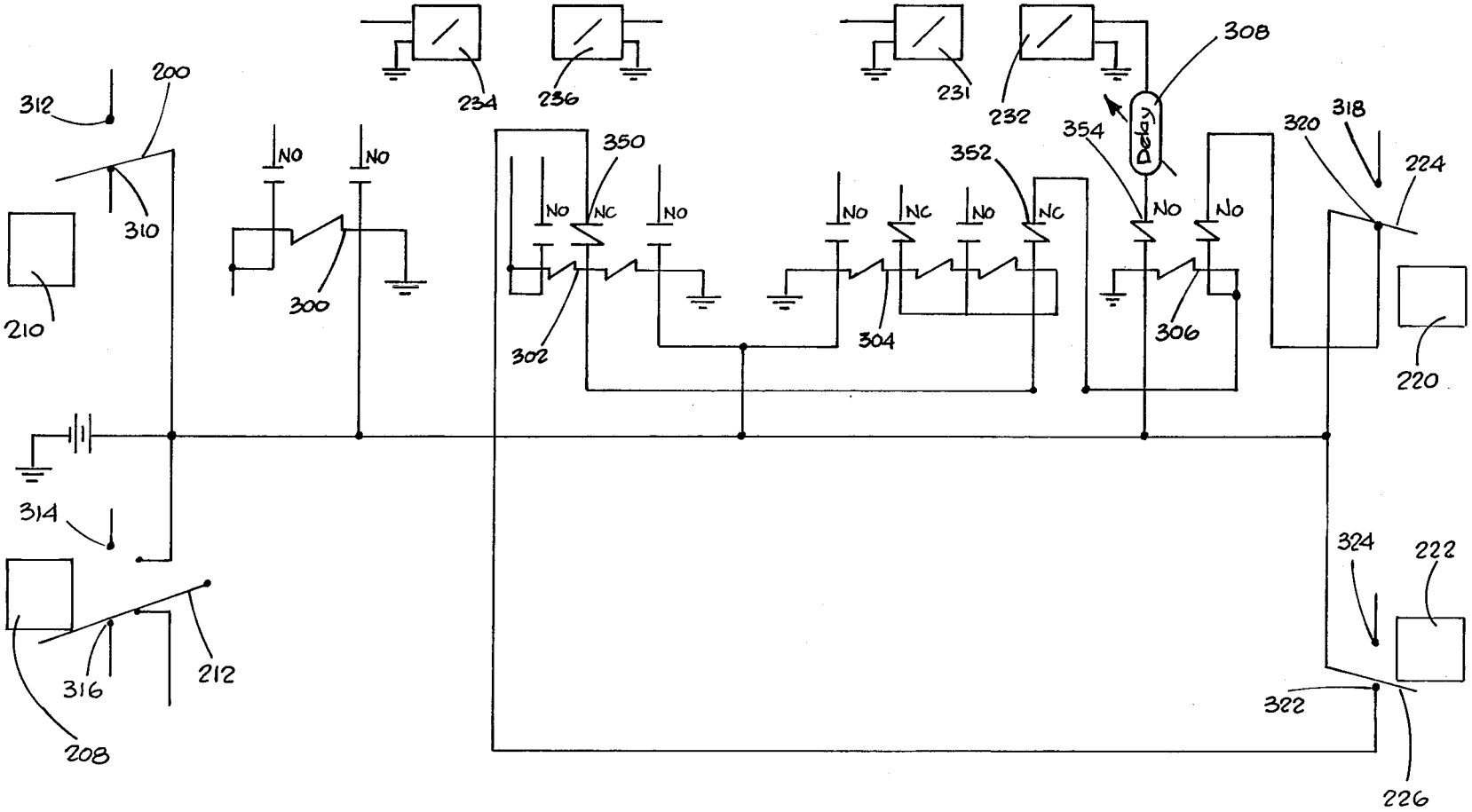
FIGS. 8–10 are schematic diagrams showing certain electrical components for the three different phases of operation of FIGS. 5–7.
Figure 9:
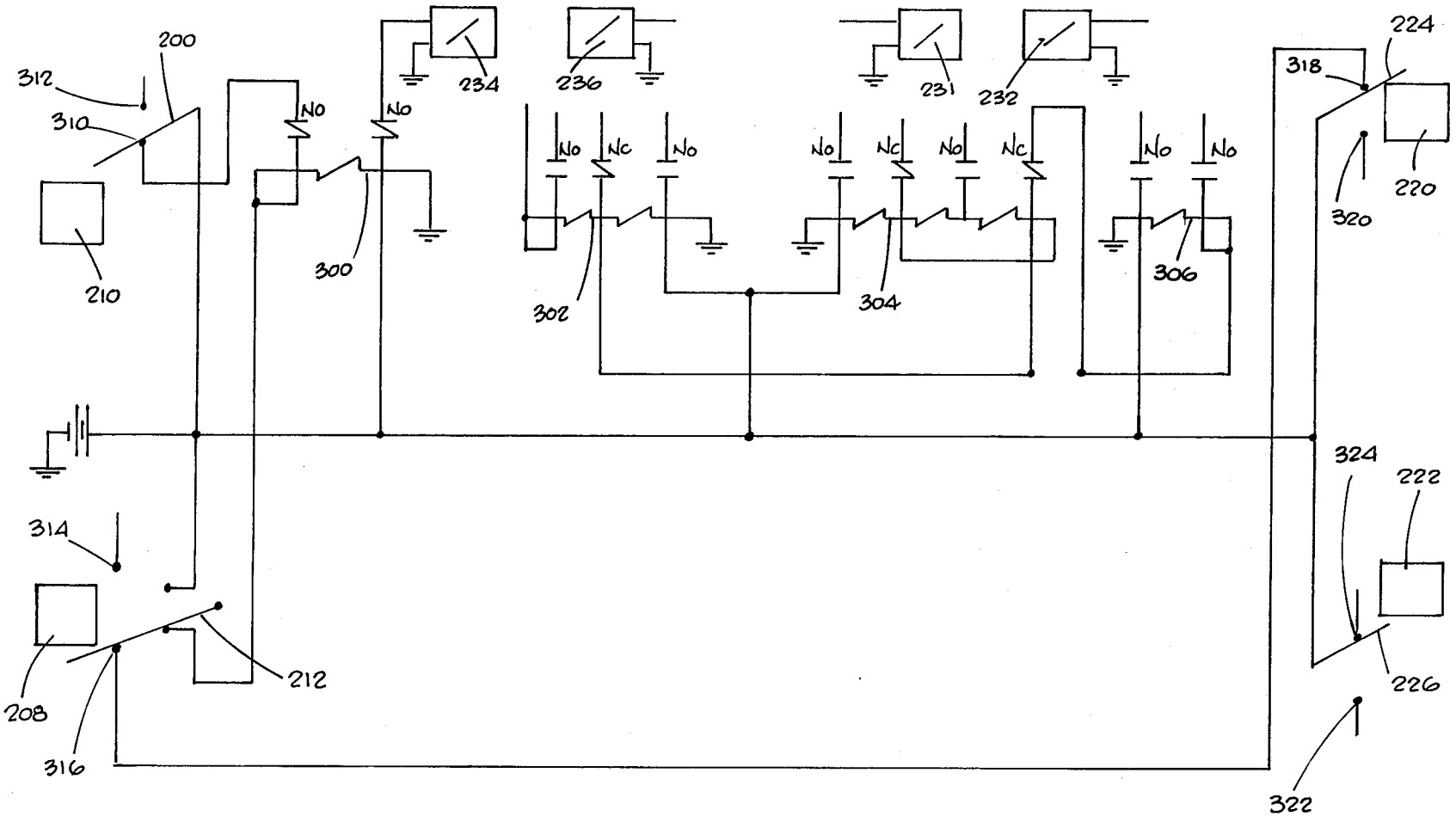
Figure 10:
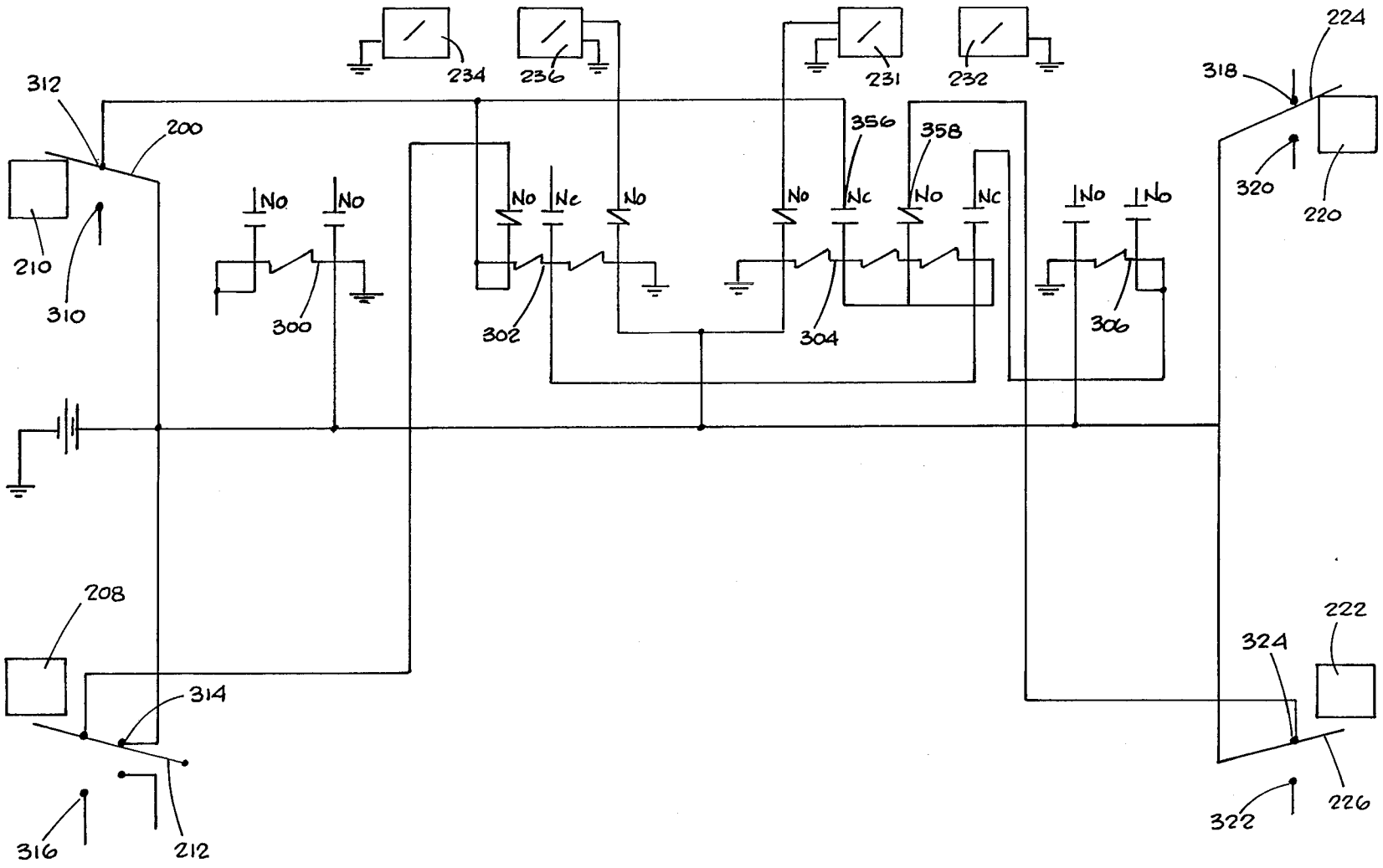

Referring to FIGS. 8–10, these show portions of the electrical system of the crushing apparatus for the three positions shown respectively in FIGS. 2–4. The solenoids 234, 236, 231 and 232 shown in FIGS. 5–7, are controlled by four relays 300, 302, 304 and 306 respectively. These relays have normally open and normally closed contacts as shown. An adjustable time delay device 308 is located between relay 306 and solenoid 232 as shown only in FIG. 8.

Limit switch 200 has two contacts 310 and 312. Current is supplied to contact 312 only when stop 210 contacts switch 200 as shown in FIG. 10. Current is supplied to contact 310 when stop 210 does not contact switch 200 as shown in FIGS. 8 and 9. Switch 212 has two pairs of contacts 314 and 316. Contacts 314 are open and contacts 316 are closed when stop 208 contacts switch 212 as shown in FIGS. 8 and 9. Contacts 316 are open and contacts 314 are closed when the stop 208 does not contact switch 212 as shown in FIG. 10.

Limit switch 224 has contacts 318 and 320. Current is supplied to contact 318 only when stop 220 contacts switch 224 as shown in FIGS. 9 and 10. When stop 220 does not contact switch 224, current is supplied to contact 320 as shown in FIG. 8. Similarly, switch 226 has contacts 322 and 324. Current is supplied to contact 322 when stop 222 contacts switch 226 as shown in FIG. 8. Otherwise power is supplied to contact 324 when the stop 222 does not contact switch 226 shown in FIGS. 9 and 10.

The operation of the crushing apparatus is described firstly with reference to FIG. 2 which shows the jaws in their initial, or most open positions, and the toggle mechanisms 32 and 68 in their most angular positions. FIG. 5 shows the hydraulic connections for this position of the apparatus, while FIG. 8 shows the corresponding electrical connections. In this position limit switches 212 and 226 have been moved from their normal positions by stops 208 and 222. Contacts 314 of switch 212 are open and current is not supplied to contact 324 of switch 226, thus cutting off power to relays 302 and 304 which is provided when the contacts are closed as shown in FIG. 10. The cutting off of power to solenoids 236 and 231 stops a flow of hydraulic fluid to the top end of cylinder 74 and bottom end of cylinder 52 and leaves the pistons 75 and 56 in their retracted positions shown in FIG. 2. At the same time, electrical current is supplied via contact 322 of switch 226 to relay 306 via normally closed contacts 350 and 352 of relays 302 and 304. Relay 306 in turn supplies power from the power supply to solenoid 232. This provides hydraulic fluid to the end of cylinder 52 to move toggle mechanism 32 downwardly and move the jaw 18 towards the now stationary bottom mounted jaw 62.

The movement of jaw 18 towards jaw 62 is terminated when stop 220 contacts limit switch 224 as shown in FIGS. 3 and 9. Power supplied to relay 306 from contact 320 is cut off, therefore cutting off power to solenoid 232. Power supplied to relay 306 from contact 324 is cut off when stop 222 moves away from switch 226. This allows the spool in control valve 230 to center and blocks a flow of hydraulic fluid to and from cylinder 52 to hold jaw 18 stationary in the position shown in FIGS. 3 and 4. At the same time, current is supplied to contact 318 of switch 224 to connect the power supply to normally open contacts 316 of limit switch 212. These contacts are closed in the position of FIG. 9 due to stop 208 contacting switch 212. This provides power to activate relay 300 as shown in FIG. 9 to supply power to solenoid 234 and activate control valve 228 as shown in FIG. 6. Hydraulic fluid is thus supplied to the bottom of cylinder 74 to extend piston 75. This moves toggle mechanism 68 upwardly and pivots jaw 62 towards then stationary jaw 18 until it reaches the position of FIG. 4.

The movement of jaw 62 towards then stationary jaw 18 is terminated when stop 210 contacts limit switch 200 to cut of current to contact 310. Thus power is no longer supplied to relay 300 and solenoid 234 to momentarily position control valve 228 in its blocked central position. Contact 312 of limit switch 200 is then supplied with current and this activates the relays 302 and 304 to provide current to solenoids 236 and 231 and to move the spools and control valves 228 and 230 to permit hydraulic fluid to enter the bottom end of cylinder 52 and top end of cylinder 74. Relay 304 has overlapping contacts 356 and 358. Normally open contacts 358 close before normally closed contacts 356 open. Thus power to relay 304 is initially supplied from contact 312 of switch 200 through contacts 356 and then, when the relay is activated, from contact 324 of switch 226 through contacts 358. The pistons 56 and 75 are thus retracted, moving toggle mechanisms 32 and 68 towards their most angular positions and opening the jaws until the positions of FIGS. 2, 5 and 8 are resumed. Power is no longer supplied to relay 304 from contact 324 of switch 226 as stop 222 contacts the switch and the cycle begins again.

In its movement from the position of FIG. 2 to the position of FIG. 3, the crushing apparatus operates in the conventional manner with the top mounted jaw moving and the other jaw stationary. However, in its movement from the position of FIG. 3 to the position of FIG. 4, the crushing apparatus offers significant advantages over such earlier devices. Because jaw 62 has a greater travel near its top, it gives a faster fracture in large rocks entering opening 14. Because of the mechanical advantage near the bottom of this jaw, due to its closer proximity to its pivot about trunnion 64, material near the bottom of this jaw can be crushed to a smaller size than in a conventional jaw crusher.

As shown in FIG. 8 only, an adjustable time delay device is used between relay 306 and solenoid 232. A solid state timing relay is a suitable device. This permits a selective delay in the closing of jaw 18 to give time for materials to move downwardly between the jaws before jaw 18 moves towards jaw 62. It is preferred to have the time during which the jaws are closing represent only 25% to 35% of each cycle to give time to allow material to pass downwardly between the jaws.

What is claimed is:

1. A crushing apparatus, comprising:

a main frame having a top;

an opening near the top of the main frame for admitting material to be crushed;

a first jaw having a top and being connected to the frame on one side of the opening by a first pivotal connection near the top of the jaw;

a first toggle mechanism operatively associated with the top mounted jaw;

a second jaw having a bottom and being connected to the frame on a side of the opening opposite the first jaw by a second pivotal connection near the bottom of the second jaw; and a second toggle mechanism operatively associated with the second jaw.

2. An apparatus as claimed in claim 1, further comprising first actuating means operatively associated with the first toggle mechanism for providing movement of the first jaw about the first pivotal connection and second actuating means operatively associated with the second toggle mechanism for providing movement of the second jaw about the second pivotal connection.

3. An apparatus as claimed in claim 2, further comprising control means for controlling the first and second actuating means through an operating cycle where the second jaw is initially held stationary in an initial position while the first jaw is moved towards the second jaw, then the first jaw is held stationary while the second jaw is moved from an initial position towards the first jaw and then both said jaws are retracted to their respective initial positions.

4. An apparatus as claimed in claim 3, wherein the first actuating means is a first hydraulic cylinder connected to the first toggle mechanism and the second actuating means is a second hydraulic cylinder connected to the second toggle mechanism.

5. An apparatus as claimed in claim 4, wherein the means for controlling comprises position sensing means for detecting the positions of the toggle mechanisms and fluid control means for controlling hydraulic fluid flow to or from the cylinders.

6. An apparatus as claimed in claim 5, wherein the sensing means comprises at least on limit switch associated with each toggle mechanism and a fluid control valve associated with each cylinder.

7. An apparatus as claimed in claim 4, wherein each said toggle mechanism has a primary toggle with a first end pivotally mounted on the jaw associated therewith and a second end, and a secondary toggle having a first end pivotally mounted on the second end of the primary toggle and a second end pivotally mounted on a toggle mount normally held stationary with respect to the frame, the hydraulic cylinders being pivotally connected to the primary toggles near the second ends thereof, each of the toggle mechanisms having an extended position where the toggles approach alignment with an axis and a retracted position where the toggles are more angularly displaced relative to the axis.

8. An apparatus as claimed in claim 7, wherein the toggle mechanisms are in their retracted positions when the jaws are in their initial positions, the apparatus further comprising a first valve means for supplying hydraulic fluid to a first end of the first hydraulic cylinder and for moving the first toggle mechanism from its retracted position towards its extended position, a first limit switch means for controlling the first valve means to stop a flow of fluid to the first cylinder when the first toggle mechanism reaches its extended position, a second valve means for supplying fluid to a first end of the second hydraulic cylinder, the second valve means being controlled by the first limit switch to supply fluid to move the second toggle mechanism from its retracted position to its extended position after the first toggle mechanism is in its extended position, a normally closed third valve means for supplying fluid to a second end of the first cylinder and for moving the first toggle mechanism to its retracted position, a normally closed fourth valve means for supplying fluid to a second end of the second cylinder and for moving the second toggle mechanism to its retracted position and a second limit switch means for sensing the retracted position of the second toggle mechanism, the third and fourth valve means being controlled by the second limit switch means to supply fluid to return the toggle mechanism to their retracted positions after the second toggle mechanism reaches its extended position.

9. An apparatus as claimed in claim 4, wherein the jaws have an open position with a distance between the jaws, each said toggle mechanism having a stroke whereby each said jaw is moved towards the other said jaw;

each toggle mechanism having a primary toggle with a first end hingedly mounted on the jaw associated therewith and a second end, and a secondary toggle having a first end hingedly mounted on the second end of the primary toggle and a second end pivotally mounted on a toggle mount normally held stationary with respect to the frame, the hydraulic cylinders being pivotally connected to the primary toggles near the second ends thereof, each of the toggle mechanisms having an extended position where the toggles approach alignment with an axis and a retracted position wherein the toggles are more angularly displaced relative to the axis;

one of the toggle mounts associated with a first said jaw being adjustably movable towards or away from the first jaw.

10. An apparatus as claimed in claim 9, further comprising:

a toggle tension spring means associated with each said toggle mechanism, each said toggle tension spring means having one end connected to one of the jaws for biasing the one jaw towards the toggle mechanism operatively associated therewith, a first said toggle tension spring means being connected to the one jaw and having a second end connected to a spring mount which is adjustably movable with respect to the frame in a direction towards or away from the one jaw.

11. An apparatus as claimed in claim 10, wherein the one toggle mount and the spring mount are operatively connected for simultaneous movement towards or away from the one jaw to keep the tension of the one spring constant for a given position of the one jaw.

12. An apparatus as claimed in claim 11, further comprising hydraulic cylinders connected to the one toggle mount and said spring mount for moving these mounts, the cylinders being interconnected by hyraulic circuits.

13. An apparatus as claimed in claim 12, wherein the one jaw has two said toggle tension spring means, each connected to a separate said spring mount, each said spring mount being connected to a separate said hydraulic cylinder, the cylinders connected to the spring mounts having a cross-sectional area one-half that of the cylinder connected to the one toggle mount.

14. A crushing apparatus as claimed in claim 1, further comprising time delay means for delaying movement of one said jaw towards another said jaw.

15. A crushing apparatus comprising:

a main frame;

an opening near the top of the frame for admitting material to be crushed;

a pair of jaws mounted on the frame on opposite sides of the opening, at least one of the jaws being pivotally mounted to the frame;

a toggle mechanism connected to the one jaw for moving the one jaw to crush material between the jaws, the toggle mechanism having a primary toggle with a first end pivotally mounted on the one jaw and a second end, and a secondary toggle having a first end pivotally mounted on the second end of the primary toggle and a second end pivotally mounted on a toggle mount movably mounted on the frame; and a hydraulic cylinder connected to the primary toggle near the second end thereof for powering the toggle mechanism.

16. A crushing apparatus as claimed in claim 15, wherein the hydraulic cylinder acts in a direction to straighten the toggle mechanism from a position where the primary toggle and the secondary toggle are angularly misaligned.

17. An apparatus as claimed in claim 16, further comprising a toggle tension spring means for biasing the one jaw away from the other said jaw, the spring means having one end connected to the one jaw and another end connected to a spring mount, the spring mount being movably mounted with respect to the frame.

18. An apparatus as claimed in claim 17, wherein the toggle mount and the spring mount are operatively connected for simultaneous movement to keep the spring tension constant for a given position of the one jaw.

19. An apparatus as claimed in claim 18, further comprising hydraulic cylinders connected to the mounts for moving the mounts, the cylinders being operatively interconnected by a hydraulic conduit.

20. An apparatus as claimed in claim 17, wherein there are two toggle tension spring means connected to the one jaw, each said spring means having one said spring mount connected thereto and a hydraulic cylinder with a cross-sectional area which is one-half the cross-sectional area of the cylinder connected to the toggle mount.

21. A crushing apparatus as claimed in claim 15, further comprising time delay means for adjustably delaying movement of the one jaw towards the other said jaw.

* * * * *